US009398997B2

(12) United States Patent
Lindholm

(10) Patent No.: US 9,398,997 B2
(45) Date of Patent: Jul. 26, 2016

(54) FOLDABLE SEXUAL DEVICE

(76) Inventor: John Clifton Lindholm, Benicia, CA (US)

( * ) Notice: Subject to any disclaimer, the term of this patent is extended or adjusted under 35 U.S.C. 154(b) by 494 days.

(21) Appl. No.: 13/360,769

(22) Filed: Jan. 29, 2012

(65) Prior Publication Data

US 2012/0197073 A1 Aug. 2, 2012

Related U.S. Application Data

(60) Provisional application No. 61/438,258, filed on Feb. 1, 2011.

(51) Int. Cl.
*A61H 19/00* (2006.01)
*A47C 15/00* (2006.01)

(52) U.S. Cl.
CPC ..... *A61H 19/44* (2013.01); *A47C 15/008* (2013.01); *A61H 2201/0138* (2013.01); *A61H 2201/0161* (2013.01)

(58) Field of Classification Search
CPC ..... A61H 19/44; A61H 19/00; A61H 2201/0142; A47C 15/008
USPC ..... 600/38; 128/845, 846; 5/929; 602/32; 297/325, 246, 25
See application file for complete search history.

*Primary Examiner* — Christine H Matthews
(74) *Attorney, Agent, or Firm* — Michael Ries

(57) ABSTRACT

The present invention is a foldable sexual device that includes a handle, a seat frame that includes a plurality of rollers and is rotated by a user while utilizing the foldable sexual device, a seat bar that allows the user to rotate the seat frame up or down and a pivot hinge point that allows the seat frame to rotate on the pivot hinge point. The device also includes a first support leg and a second leg support to support and stabilize the foldable sexual device, a phallus that moves upward and downward above and through the seat frame to provide sexual pleasure to the user, a seat that is disposed on the seat frame, a pair of corresponding arms that includes a slip bushing and a phallus base that is moved upward and downward by the pair of corresponding arms and the slip bushing.

12 Claims, 3 Drawing Sheets

FOLDABLE SEXUAL DEVICE

This application claims priority to U.S. Provisional Application 61/438,258 filed on Feb. 1, 2011, the entire disclosure of which is incorporated by reference.

TECHNICAL FIELD & BACKGROUND

There are hundreds of devices used for sexual masturbation, stimulation and therapeutic purposes. Many of these devices are relatively large and cumbersome as well as having a remote chance of discretionary use. Many of these devices are contraptions that are complicated and unsafe to use and can include electro-mechanical components that make noises like a cement mixer or blender, thus being distracting to the user or others in the same vicinity. Aside from being very noisy, electro-mechanical machines are not comfortable to operate since they must be adjusted to accommodate a user rather than the machine adjusting automatically adjusting and accommodating a user. Many of these devices have a jab like thrust that could be quite painful if a user changes the position of device entry. In fact if the machine doesn't sense pain or change in a mood or emotion of the user, most devices have a speed control and or a thrust control that can be regulated during use to achieve suitable stimulation, which can be very distracting, especially during a climax or other desired event. Most electro-mechanical sexual devices also do not consider the noise generated by their sexual device.

The sound of electric motors, use of slapping accessories and abrupt stopping capability make these devices very detectable and conspicuous. Electrical controls that have no sensing devices for pain or discomfort have a need to be controlled during stimulation, thus detracting from stimulation. Many of these devices need electricity so they cannot be used anywhere and could come unplugged at an unwanted moment and are not engineered for silent running and may need a partner that may not be available at a time of desired usage.

The present invention generally relates to a sexual device. More specifically, the invention is a foldable sexual device.

It is an object of the invention to provide a foldable sexual device that is relatively quieter than a traditional sexual device.

It is an object of the invention to provide a foldable sexual device that can be relatively easily folded-up to be easily and discreetly stored.

It is an object of the invention to provide a foldable sexual device that does not require a partner and can be relatively easily adjustable to accommodate pain or change in a mood or emotion of the user and to adjust the depth of penetration to control pain.

What is really needed is a foldable sexual device that is relatively quieter than a traditional sexual device that can be relatively easily folded-up to be easily and discreetly stored that does not require a partner and can be relatively easily adjustable to accommodate pain or change in a mood or emotion of the user.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Figure 1A:
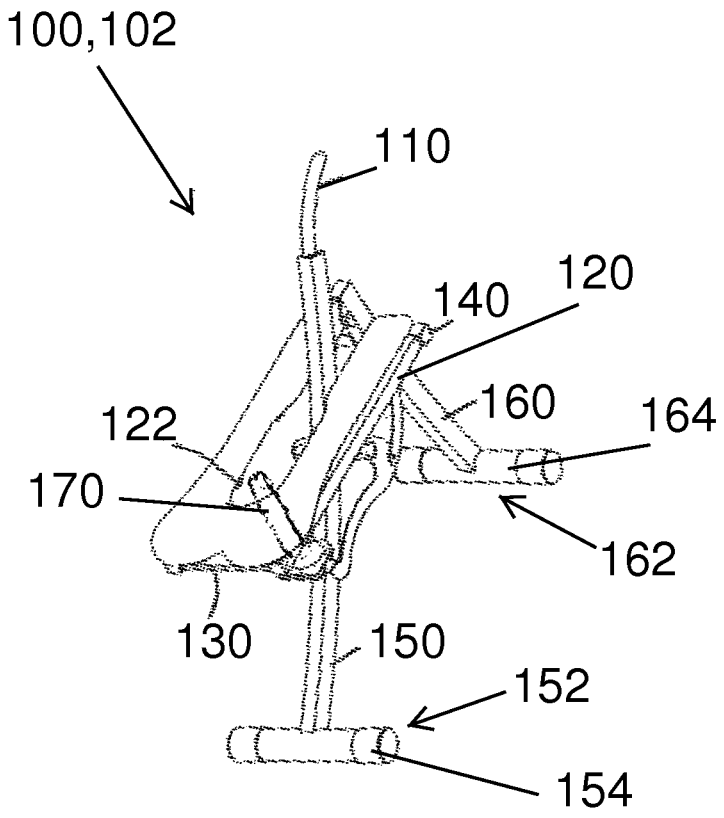
FIG. 1A illustrates a top perspective view of a foldable sexual device in an open position, in accordance with one embodiment of the present invention.

FIG. 1A illustrates a top perspective view of a foldable sexual device 100 in an open position 102, in accordance with one embodiment of the present invention. The foldable sexual device 100 includes a handle 110, a seat frame 120, a seat bar 130, a pivot hinge point 140, a first support leg 150, a second support leg 160 and a phallus 170. The handle 110 is grasped by a user while using the foldable sexual device 100 and can be made of any suitable material such as plastic or rubber and have any suitable ergonomic shape. The seat frame 120 includes a plurality of rollers 122 and can be rotated by the user while utilizing the foldable sexual device 100 where one hand of the user grasps the handle 110 and the other hand of the user rotates the seat frame 120. The seat bar 130 also allows a user to rotate the seat frame 120 up or down while the user uses the foldable sexual device 100. The pivot hinge point 140 allows the seat frame 120 to rotate on the pivot hinge point 140. The first support leg 150 has a distal end 152 and extends generally diagonally with a perpendicular ground support 154 disposed on the distal end 152 to further support and stabilize the foldable sexual device 100. The second support leg 160 has a distal end 162 and is generally vertical with a perpendicular ground support 164 disposed on the distal end 162 to further support and stabilize the foldable sexual device 100. The phallus 170 moves upward and downward above and through the seat frame 120 to provide sexual pleasure to the user, which can be male or female. The phallus 170 can be made of any suitable material such as rubber or plastic and be of any suitable length. The linkage arms also provided settings for length of penetration for different users.

Figure 1B:
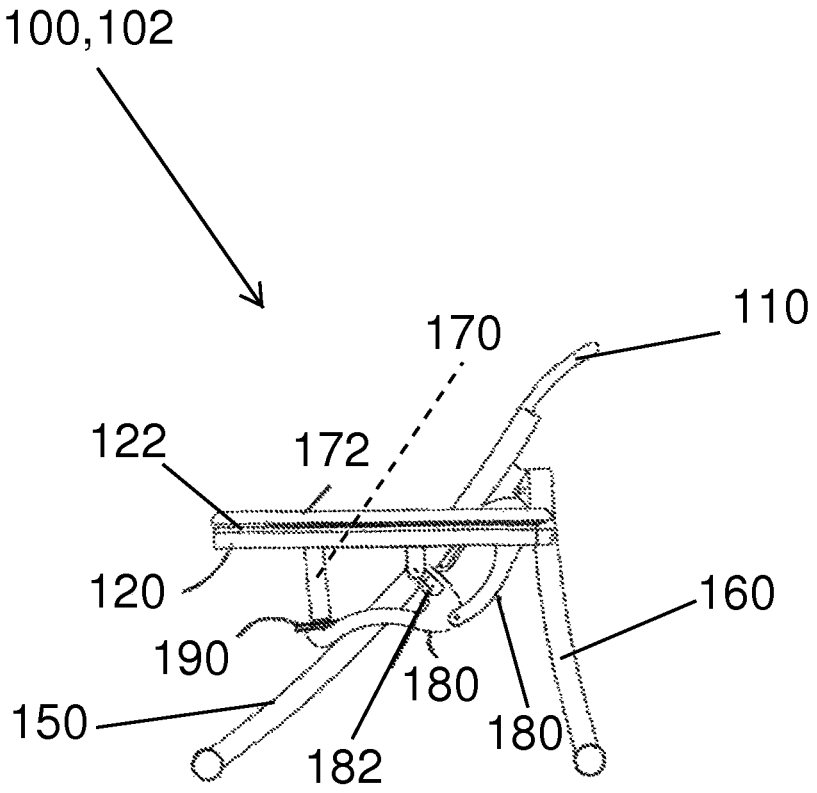
FIG. 1B illustrates a side view of a foldable sexual device in an open position, in accordance with one embodiment of the present invention.

FIG. 1B illustrates a side view of a foldable sexual device 100 in an open position 102, in accordance with one embodiment of the present invention. The foldable sexual device 100 includes similar elements to the foldable sexual device 100 described and illustrated in FIG. 1A and its description. The foldable sexual device 100 includes a handle 110, a seat frame 120, a seat bar 130, a pivot hinge point 140, a first support leg 150, a second support leg 160 and a phallus 170.

Additionally, the foldable sexual device 100 includes a seat 172, a pair of corresponding arms 180 and a phallus base 190. The seat 172 is disposed on the seat frame 120 and is typically padded and can be made out of any suitable material such as vinyl or soft rubber. The user can sit on the foldable sexual device 100 without clothes in a front-facing position or a back-facing position. The user can thrust his or her hips while sitting on the seat 172. The pair of corresponding arms 180 includes a slip bushing 182 that are all attached to the seat 172 and together move while the user thrusts his or her hips while sitting on the seat 172. The slip bushing 182 attaches each of the pair of corresponding arms 180 together allowing the seat 172 to move while the user thrusts his or her hips while sitting on the seat 172. The phallus base 190 is also moved upward and downward by the pair of corresponding arms 180 and slip bushing 182. The phallus 180 is generally perpendicularly attached to the phallus base 190 and is also moved upward and downward above and through the seat frame 120 to provide sexual pleasure to the user, although the phallus 180 can be attached to the phallus base 190 at any suitable angle or position as well. As the pair of corresponding arms 180 and slip bushing 182 moves with the seat 172 and the user the seat 172 moves on the rollers 122 to provide a silent and smooth movement along the seat frame 120.

Figure 1C:
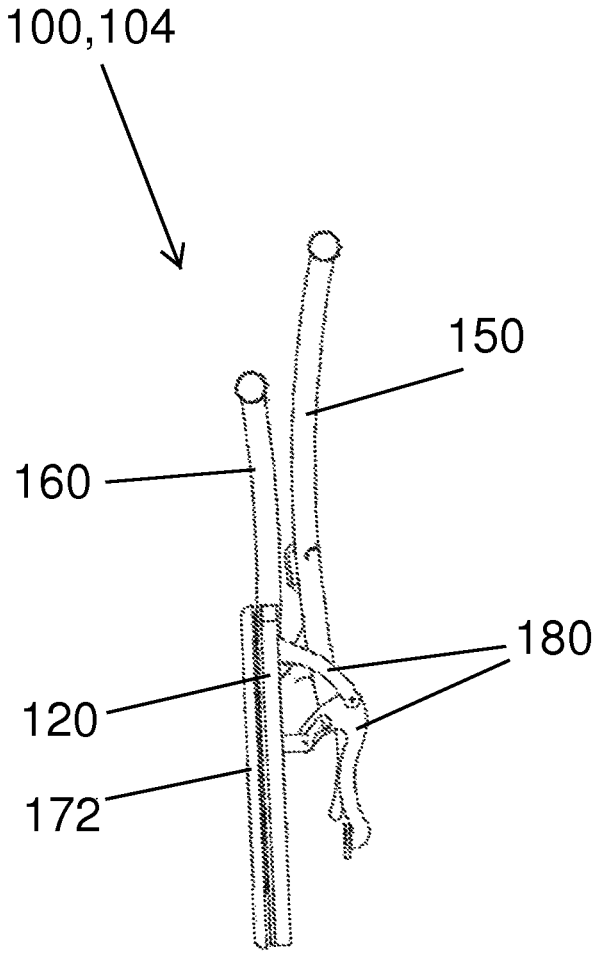
FIG. 1C illustrates a side view of a foldable sexual device in a folded position, in accordance with one embodiment of the present invention.

FIG. 1C illustrates a side view of a foldable sexual device 100 in a folded position 104, in accordance with one embodiment of the present invention. The foldable sexual device 100 includes similar elements to the foldable sexual device 100 described and illustrated in FIGS. 1A and 1B and their descriptions. The foldable sexual device 100 includes a handle 110, a seat frame 120, a seat bar 130, a pivot hinge point 140, a first support leg 150, a second support leg 160, a phallus 170, a seat 172, a pair of corresponding arms 180, a slip bushing 182 and a phallus base 190. The foldable sexual device 100 illustrated in FIG. 1C is in a folded position 104 is only approximately 7 inches in height or can be any other suitable height when folded-up and can be stored underneath a bed or other suitable area.

The foldable sexual device operates like an everyday folding chair where a user can sit forward or backwards. The seat will move in and out up to approximately 3 inches or any other suitable distance. The movement of the user's hips backward motion will insert a phallus at an accelerated rate of up to approximately 8 inches in response to the rhythm and movement of the user. This movement is relatively difficult to achieve by hand and can be relatively very awkward and tiring and detracts from the pleasure of masturbation.

The phallus can also be attached to a chair or a wall and the user can thrust onto the phallus from that position. However, this has setbacks since this can be relatively awkward to use and after a period of time a user may experience knee pain that will detract from any pleasure. The foldable sexual device allows for uninterrupted and undistracted intimacy since it is relatively quieter and silent, allowing convenient private use at any suitable venue or location. It can be folded-up in approximately 2 seconds and locks in place without collapsing even under severe misuse. The foldable sexual device is relatively compact, portable and works without electricity. The foldable sexual device has no straps, locks, pinch points or a possibility of an electric shock. The foldable sexual device solves the problem of manipulating a phallus by using natural body movement for stimulation in a comfortable seated position. No squeaks, knocks, slick noises or motor controls to ruin any sexual related moments. The foldable sexual device has an operating foot print of approximately 18 inches in width and approximately 27 inches in length and weighs approximately 14 lbs. It is collapsible to approximately 5 inches in height to allow a user to store the foldable sexual device under a bed for storage and privacy. It also has a convenient carrying bag and is made of steel for durable use.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A foldable sexual device, comprising:

a handle capable of being grasped by a user with two hands and two hips while using said foldable sexual device;

a seat frame that includes a plurality of rollers and is capable of being rotated by said user while utilizing said foldable sexual device;

a seat bar that allows said user to rotate said seat frame up or down while said user uses said foldable sexual device;

a pivot hinge point that allows said seat frame to rotate on said pivot hinge point;

a first support leg that has a distal end and extends generally diagonally to further support and stabilize said foldable sexual device;

a second support leg that has a distal end and is generally vertical with a perpendicular ground support disposed on the distal end of the second support leg to further support and stabilize the foldable sexual device;

a phallus that is capable of moving upward and downward with a straight line motion above and through said seat frame to provide sexual pleasure to said user;

a seat that is disposed on said seat frame;

a pair of corresponding arms that includes a slip bushing that are attached to said seat and together move while said user thrusts said hips while sitting on said seat; and a phallus base that is capable of moving upward and downward by said pair of corresponding arms and said slip bushing, and said phallus being generally perpendicularly attached to said phallus base, the phallus capable of moving in a vertical straight line motion.

2. The device according to claim 1, wherein said handle is made of rubber.

3. The device according to claim 1, wherein said handle is made of plastic.

4. The device according to claim 1, wherein said first support leg has a perpendicular ground support disposed on said distal end of said first support leg.

5. The device according to claim 1, wherein said phallus is made of rubber.

6. The device according to claim 1, wherein said phallus is made of silicone.

7. The device according to claim 1, wherein said seat is padded.

8. The device according to claim 1, wherein said seat is made of molded padding.

9. The device according to claim 1, wherein said seat is made of leather.

10. The device according to claim 1, wherein said seat is capable of moving on said rollers to provide a silent and smooth movement along said seat frame.

11. The device according to claim 1, wherein said foldable device is approximately 7 inches in height when in a folded position.

12. The device according to claim 1, wherein said foldable sexual device weighs approximately 15 lbs.

* * * * *